United States Patent [19]

Kaupert

[11] 4,309,889

[45] Jan. 12, 1982

[54] METHOD AND APPARATUS FOR THE FORMING OF A SERIES OF TROUGHS INTO A METAL FOIL STRIP

[76] Inventor: Guenther Kaupert, Thueringer Str. 1, Erndtebrueck, Fed. Rep. of Germany, 5927

[21] Appl. No.: 94,655

[22] Filed: Nov. 15, 1979

Related U.S. Application Data

[62] Division of Ser. No. 859,457, Dec. 12, 1977, Pat. No. 4,241,599.

[51] Int. Cl.[3] ..... B21D 22/06
[52] U.S. Cl. ..... 72/356; 72/379
[58] Field of Search ..... 72/356, 379, 324; 113/116 R, 116 Y

[56] References Cited

U.S. PATENT DOCUMENTS 3,251,319 5/1966 Kaupert et al. ..... 72/356 X
3,307,387 3/1967 Lacey et al. ..... 72/324

*Primary Examiner*—Eugene F. Desmond
*Attorney, Agent, or Firm*—Klaus J. Bach

[57] ABSTRACT

Method and apparatus for forming a series of elongated troughs having different widths at their opposite ends into a metal foil strip in several forming stages with the aid of sets of upper and lower dies which, one after the other, engage the metal strip which is promoted stepwise from stage to stage. The troughs are formed in a pre-forming stage with the same width at both ends and in the final forming stages the width of the trough at one end is reduced by the formation of pleats so as to obtain the final form of the troughs without bending of the strip.

6 Claims, 9 Drawing Figures

METHOD AND APPARATUS FOR THE FORMING OF A SERIES OF TROUGHS INTO A METAL FOIL STRIP

This is a division of application Ser. No. 859,457, filed Dec. 12, 1977, now U.S. Pat. No. 4,241,599, issued Dec. 30, 1980.

BACKGROUND OF THE INVENTION

1. Field of the Invention

The invention relates to a method and apparatus for the stepwise forming of a series of troughs of varying depth and width into a metal strip with the aid of a number of sets of bottom (male) and top (female) dies sequentially applied to the metal strip to gradually form the troughs. At least the first of the sets of bottom and top dies serves to pre-form the metal strip which is, in additional forming steps, further impressed until the desired trough is embossed in the metal strip.

2. Description of the Prior Art

It is difficult to impress troughs into thin metal foil strips since they are very susceptible to cracking. German Pat. Nos. 1,162,316; 1,198,314 and 1,217,911 show how cracking of the metal foil can be avoided if the impressions are made carefully and sufficient foil material is available in the imprint area. In order to have sufficient foil material available it has, for example, been proposed to prepleat the strip in the area in which a trough is to be impressed.

German publication DT-AS No. 1,602,485 proposes to imprint, during the initial impressing steps, a trough which is deeper than the final trough and to leave a gap between the bottom and top dies in their engaged positions. This, especially, facilitates the forming of decorative pleats in the bottom wall of the trough. As a result of the right-angled side walls of the troughs and a uniform cross-section, the consumption of material is naturally constant over the full length of the trough. However, if the cross-section is not uniform over the length of a trough (i.e. the width of the metal strip) that is if the trough has no uniform depth or width the strip material consumption is different at the opposite sides of the strip and the strip tends to deviate from the rectilinear advancing movement through the successive forming stages which may result in faulty imprints.

SUMMARY OF THE DISCLOSURE

A new method and apparatus for forming a series of elongated troughs with different cross-sections at their opposite ends into a metal foil strip in such a manner that the strip travels rectilinearly through the apparatus consisting of several sets of lower and upper dies which, one after the other, engage the metal strip that is moved stepwise from stage to stage. In a first stage a pleat is formed across the strip which is then formed into a trough having essentially the same cross-section at both ends. In the final forming stages the size of the trough is then reduced by the formation of pleats in the side wall of the trough at one end thereof so as to obtain the final form of the trough. With this method the same amount of strip foil is consumed at both sides of the strip so that the strip moves rectilinearly through the apparatus without jamming.

BRIEF DESCRIPTION OF THE DRAWINGS

The invention will become more readily apparent from the following description of preferred embodiments thereof explained in connection with drawings in which.

DESCRIPTION OF THE PREFERRED EMBODIMENTS

Figure 1:
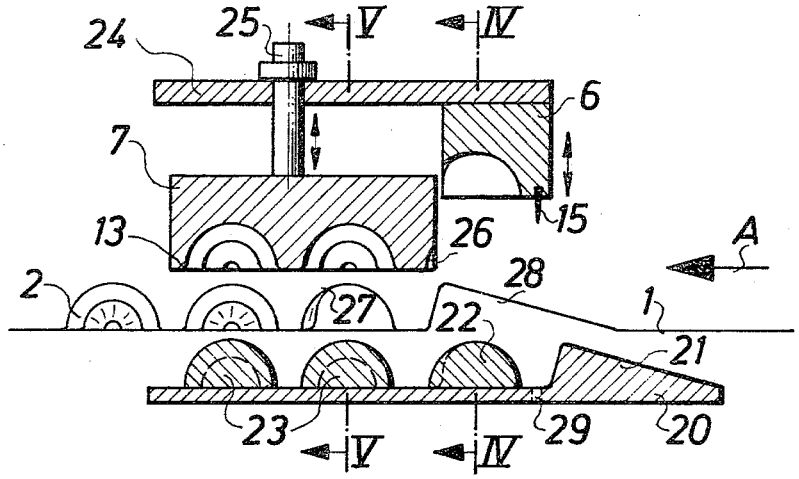
FIG. 1 shows, in cross-section along lines I—I of FIG. 2, the bottom and top dies in opened positions with a metal strip therebetween.

An apparatus for forming troughs as shown in FIG. 1 includes a bottom (male) die structure 20 having a projection 21, a pre-forming member 22 and two finishing forming portions 23 and a top die having a pre-forming die portion 6 and a finishing die portion 7. A thin metal strip 1 such as aluminum foil is disposed between the top and bottom dies and is advanced stepwise when the dies are spaced apart. After each advancing step the top and bottom dies are closed for stepwise forming of the troughs into the metal strip.

Figure 2:
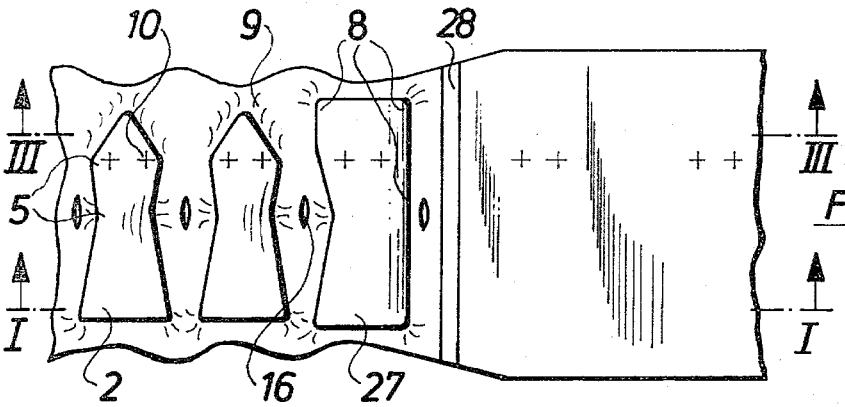
FIG. 2 is a top plan view of the metal strip showing the various impressing steps.

This is done by first forcing the finishing die portion 7 toward the finishing forming portions 23 by means of a drive shaft 25 to which the finishing die portion 7 is connected. This brings the troughs 2 of the strip 1 into their final form. At the same time, the front end surface 26 of the finishing die portion 7 forces the strip 1 in engagement with the exit end portion of the pre-forming member 22, with respect to the advancing direction (arrow A). Then, the pre-forming die portion 6 which is slidingly guided by the drive shaft 25 of the finishing die portion 7, is forced onto the pre-forming member 22 so as to generate a preliminary form 27 (FIG. 2). At the same time, the strip foil is pulled over the projection 21 thereby generating a pleat 28 extending across the width of the strip.

After these forming steps the die portions 6 and 7 are pulled back and the strip 1 is moved a step forward in the direction of arrow A. For the sake of clarity and simplicity, the drive means for the strip 1, and for the dies 6, 7, however, are not shown. They may be of any well known type.

Figure 3:
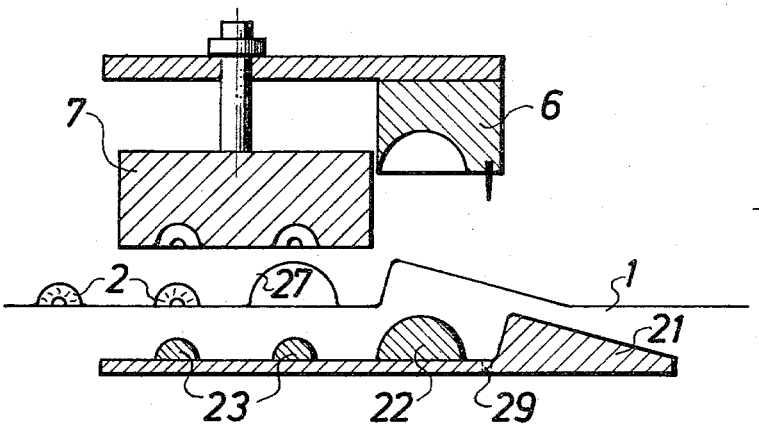
FIG. 3 is a longitudinal cross-sectional view of the apparatus with its dies spaced apart and the metal strip disposed therebetween, the cross-section being taken along line III—III of FIG. 2.

As can be seen from FIG. 2, in the pre-forming stage (pre-forming member 22, pe-forming die portion 6, front end surface 26 of the finishing die portion 7), there is formed a preliminary trough 27 which, in length as well as in width, is somewhat larger than the final trough 2. In addition, the preliminary trough 27 includes auxiliary deformations 8 which use up some strip material in order to achieve an equal consumption of strip material over the length of the preliminary trough that is over the width of the strip in spite of the different cross-sections 5 and different depths 3 of the trough along the line 4 of greatest depth in the final forming stages of the trough 2. This can be seen especially well from the cross-sectional view (FIG. 3) taken along line III—III of FIG. 2 and from FIG. 4 wherein the faces 22*a* and 22*b* are about equal in size. In the finishing stage (finishing die portion 7 and finishing forming portion 23) some of the superfluous material of the auxiliary deformations 8 is pleated so that the actual surface area thereof is reduced and the foil is brought into the final form of trough 2. In the shown example, this applies to the conical end of the trough 2 and also to a constriction in the middle of the trough 2. As it can further be seen from FIGS. 1 and 2, the constriction in the middle of the trough 2 is already initiated in the pre-forming stage by the front end surface 26 of the finishing die portion 7. In order to make use of the available foil material and, at the same time, to keep the tension in the foil within certain limits so as to avoid rupturing of the foil material during the final forming stage, slots 16 are cut into the foil strip outside the preliminary trough 27 and transverse to the direction of tensions in the strip that is in the normally unused foil material between adjacent troughs. For cutting the slots 16 the pre-forming die portion 6 is provided with a cutting blade 15 and the bottom die 20 has an opening 29 fo receiving the blade 15.

Figure 4:
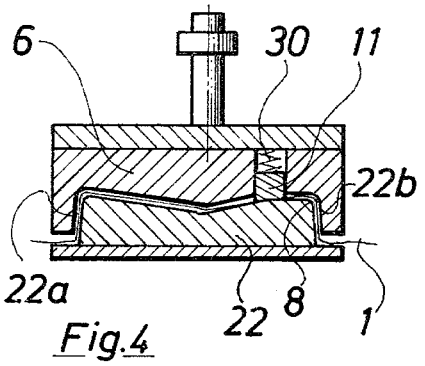
FIG. 4 is a cross-sectional view of the apparatus along lines IV—IV of FIG. 1 with the dies being closed and showing the pre-forming stage.
Figure 5:
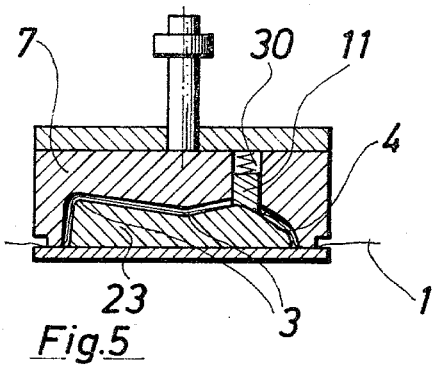
FIG. 5 is a cross-sectional view along lines V—V of FIG. 1 showing the second forming stage with the dies in the closed position.

In some cases, the metal strips have imprints and then it is necessary to hold the imprinted strip area in a predetermined position in contact with the finishing forming portion 23 even in the area of the auxiliary deformations. For this purpose the strip is clamped between the upper and lower dies at certain points 10, for example an imprint such as letters, already before the beginning of the forming step. This can be done in a simple manner by providing the pre-forming and finishing die portions 6 and 7 with studlike down holders 11 which are axially movably disposed in passages extending through the dies and springs 30 disposed in the passages which springs force the down holders into engagement with the strip (foil) before the dies (FIGS. 4, 5).

Figure 6:
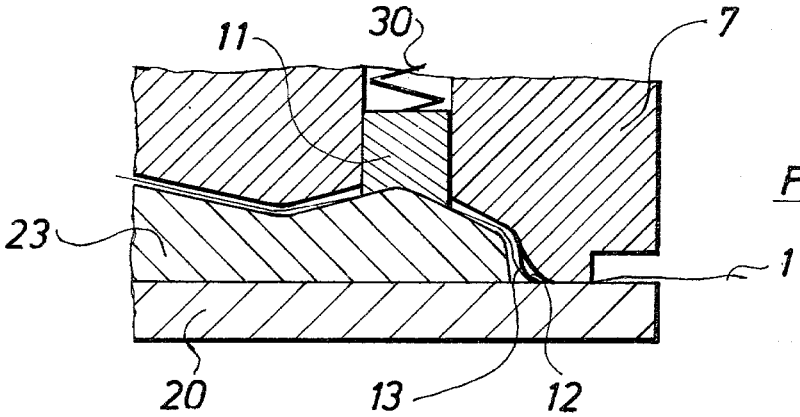
FIG. 6 is an enlarged sectional view of a portion of the second forming stage shown in FIG. 5.
Figure 7:
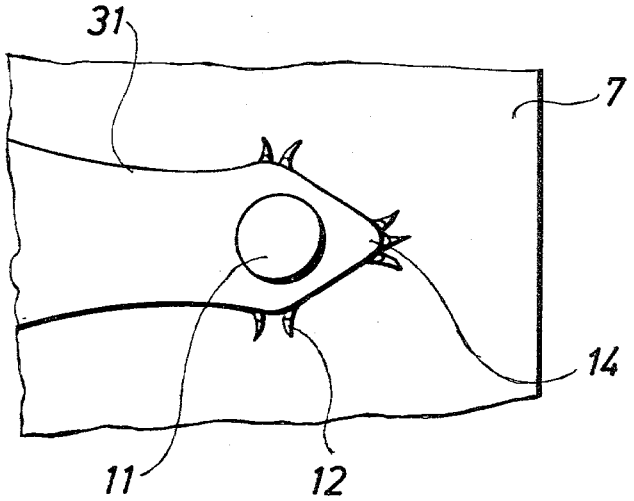
FIG. 7 is a bottom view of the top die of FIG. 6.

In the finishing stage it is especially important that the edges 13 in areas of curvatures with small radii 14 are so designed that the formation of the pleats is initiated in the desired manner already when the upper die 7 approaches the lower die in order to avoid the formation of cracks. To achieve this, the edges 13 are rounded and have grooves 12 for the control of the formation of the pleats, the grooves extending about normal to the circumference 31 of the die cavity when viewed from the bottom (FIGS. 6 and 7).

Figure 8:
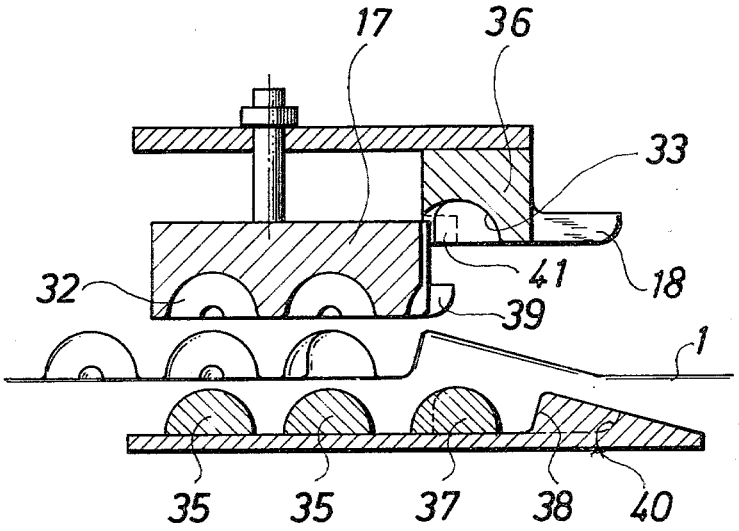
FIG. 8 is a longitudinal cross-sectional view of an apparatus for forming, in parallel, more than one series of troughs and taken along line VIII—VIII of FIG. 9.
Figure 9:
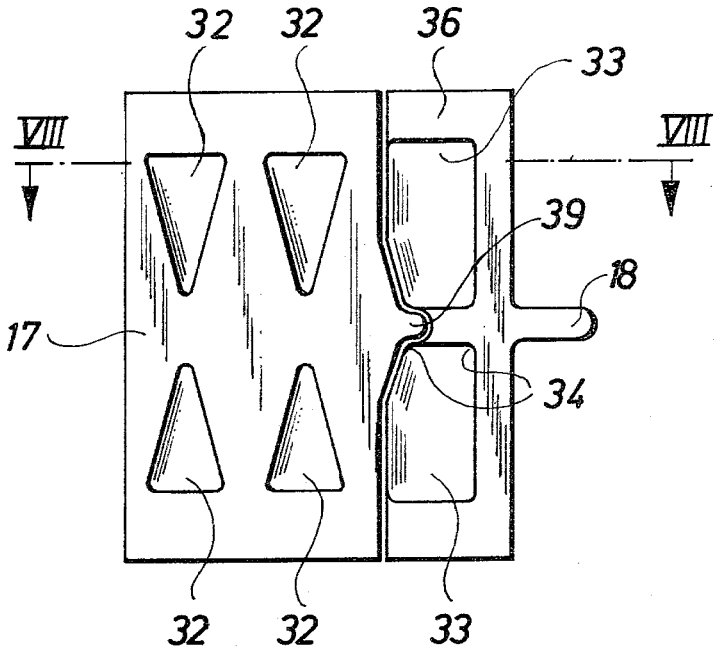
FIG. 9 is a bottom view of the top die of FIG. 8.

With the method and arrangement according to the invention it is also possible to imprint several parallel rows of troughs into the strip at the same time. A respective arrangement for doing that is illustrated in FIGS. 8 and 9. the finishing die 17 has two parallel rows of cavities 32 whose conical ends are pointed toward each other. The pre-forming die 36 also has two cavities 33 which, with respect to the cavities 32 for the final trough, have extensions 34 in line with the conical ends of the cavities 32 which extensions serve as auxiliary cavities.

Corresponding to the cavities 32 and 33 there are pairs of forming members 35, 37, and 38. At their front ends facing the incoming strip 1 (in the direction of arrow A) the top dies 17, 36 have fingers 18, 39 which protrude in a direction opposed the feed direction of the strip and which engage the strip foil in the middle between the rows of troughs so as to initiate the forming of the troughs in the pre-forming stages between the pairs of pre-forming members 37, 38. This provides for the material needed for the auxiliary cavities. The troughs are subsequently formed in the rows. The initial pre-forming member 38 and the main pre-forming member 36 have openings 40, 41 for receiving the fingers 18, 39 when the bottom and top dies are in engagement with one another.

I claim:

1. An apparatus for the stepwise forming into a metal foil strip of a series of elongated troughs extending with their length across said strip and having different cross-sections at their opposite ends, said apparatus comprising: a series of sets of upper (female) and lower (male) pre-forming, and at least two sets of final forming dies adapted to receive therebetween said metal strip for forming said troughs into said strip while said strip is intermittently advanced from set to set, said pre-forming dies having end faces of essentially the same size corresponding to the larger of the ends of the trough so as to form a preliminary trough with equal width and depth at its ends and the first of the final forming dies being smaller at one end, at least one of said final forming dies having means for pleating the side walls of said troughs at said smaller end so as to reduce the size of the trough formed in the pre-forming die while the strip is held in position in the last of the final forming dies.

2. An apparatus as recited in claim 1, wherein the set of pre-forming dies includes at least one blade mounted on one, and an opening for receiving the blade upon engagement of the dies formed in the other of the dies, said blade and opening being so arranged as to cut a slot into said strip in an area between adjacent troughs.

3. An apparatus as recited in claim 1, wherein the dies include down holders which are axially movably disposed in passages formed in the dies and which are resiliently supported so as to force the down holders in engagement with the strip before the respective die reaches the strip.

4. Apparatus as recited in claim 1, wherein the female final forming die has grooves formed in the die at the circumference of the die cavity in the area of its one end which grooves extend essentially normal to the circumference of the die cavity so as to initiate the formation of said pleats.

5. Apparatus as recited in claim 1, wherein the male die includes a projection of even cross-sections extending over the full width of the strip for forming a pleat adapted to prevent bending stresses from reaching the incoming strip foil and from which the preliminary trough is formed in the pre-forming dies.

6. Apparatus as recited in claim 5, and including at least two parallel rows of male and female dies, wherein the female pre-forming die has a finger mounted between the rows and protruding therefrom toward the oncoming foil strip and the projection has a cut-out for receiving said finger for initiating the forming of the troughs into said strip.

* * * * *